US007145588B2

(12) United States Patent
Hawver

(10) Patent No.: US 7,145,588 B2
(45) Date of Patent: Dec. 5, 2006

(54) SCANNING OPTICAL PRINTHEAD HAVING EXPOSURE CORRECTION

(75) Inventor: Jeffery R. Hawver, Marion, NY (US)

(73) Assignee: Eastman Kodak Company, Rochester, NY (US)

( * ) Notice: Subject to any disclaimer, the term of this patent is extended or adjusted under 35 U.S.C. 154(b) by 278 days.

(21) Appl. No.: 10/789,092

(22) Filed: Feb. 27, 2004

(65) Prior Publication Data

US 2005/0190212 A1 Sep. 1, 2005

(51) Int. Cl.
*B41J 2/435* (2006.01)

(52) U.S. Cl. ..... 347/236; 347/237; 347/103; 250/235; 250/234

(58) Field of Classification Search ..... 347/37, 347/40, 103, 132, 236, 237, 238, 240; 219/126.62; 250/231.14, 235; 358/1.9, 474, 482, 412, 358/514; 396/549
See application file for complete search history.

(56) References Cited

U.S. PATENT DOCUMENTS 4,074,320 A * 2/1978 Kapes, Jr ..... 358/482
4,378,149 A * 3/1983 Ebner ..... 396/549
4,475,115 A 10/1984 Garbe et al.
4,620,200 A 10/1986 Fukai
4,780,730 A * 10/1988 Dodge et al. ..... 347/237
4,789,874 A * 12/1988 Majette et al. ..... 347/37
4,835,545 A 5/1989 Mager et al.
4,835,549 A * 5/1989 Samejima et al. ..... 347/237
5,111,218 A * 5/1992 Lebeau et al. ..... 347/240
5,121,146 A * 6/1992 Smith et al. ..... 347/238
5,184,011 A * 2/1993 Hubble et al. ..... 250/231.14
5,311,216 A * 5/1994 Hirahata et al. ..... 347/132
6,010,206 A * 1/2000 Simons ..... 347/40
6,037,584 A 3/2000 Johnson et al.
6,215,095 B1 * 4/2001 Partanen et al. ..... 219/121.62
6,266,077 B1 * 7/2001 Kamimura ..... 347/236
6,422,682 B1 7/2002 Kaneko et al.
6,452,696 B1 * 9/2002 Bogart et al. ..... 358/1.9
6,499,827 B1 * 12/2002 Elgee ..... 347/37
6,576,883 B1 6/2003 McCoy
6,819,346 B1 * 11/2004 Ozaki et al. ..... 347/179
6,917,447 B1 * 7/2005 Boqart et al. ..... 358/1.9
2004/0012824 A1 * 1/2004 Haas et al. ..... 358/474

* cited by examiner

*Primary Examiner*—Hai Pham
*Assistant Examiner*—Carlos A. Martinez
(74) *Attorney, Agent, or Firm*—Nelson Adrian Blish

(57) ABSTRACT

A printing apparatus 10 exposes an image onto a photosensitive medium 14, having a printhead 20 with a linear array of exposure sources 40, each exposure source 12 operable at a variable intensity. A shuttle mechanism 16 moves the printhead 20 over the photosensitive medium 14 in a reciprocating motion between one end of a carriage assembly 72 and the other. An encoder 38 is coupled to the shuttle mechanism (16) for providing an index encoder pulse 60 at each of a plurality of increments of position of the shuttle mechanism 16 along the carriage assembly 72. Exposure control logic calculates a shuttle velocity according to index signal timing and adjusts the variable intensity of each exposure source 12 according to the shuttle velocity.

12 Claims, 5 Drawing Sheets

SCANNING OPTICAL PRINTHEAD HAVING EXPOSURE CORRECTION

CROSS REFERENCE TO RELATED APPLICATIONS

Reference is made to the following commonly-assigned copending U.S. patent application Ser. No. 10/700,832, filed Nov. 4, 2003, entitled MULTICHANNEL PRINTHEAD FOR PHOTOSENSITIVE MEDIA, by Narayan et al., the disclosure of which is incorporated herein.

FIELD OF THE INVENTION

This invention generally relates to printing apparatus for photosensitive media and more particularly relates to a scanning optical printhead using a carriage-mounted linear exposure array with exposure control.

BACKGROUND OF THE INVENTION

When high-quality images are needed, such as for diagnostic imaging applications, photosensitive media, such as film, paper, and other photosensitized substrates have marked advantages over many other types of substrates. In order to tap these advantages for images that are obtained or stored as digital data, a number of electronic printers have been developed.

One approach for exposure of a digital image onto a photosensitive medium uses a two-dimensional spatial light modulator, such as a liquid crystal device (LCD) or digital micromirror device (DMD). These devices expose a complete image frame at a time. Other printers employ linear light modulators with an array of light-emitting exposure elements, such for example as a micro light valve array (MLVA) using lead lanthanum zirconate titanate (PLZT) light valves (sold for example as the model QSS-2711 Digital Lab System manufactured by Noritsu Koki Co., located in Wakayama, Japan). This type of printer provides scanning movement of a linear array of exposure sources with respect to the surface of a photosensitized substrate. Alternate linear array exposure sources includes light emitting diode (LED) arrays. LEDs offer advantages such as low energy requirements, compact packaging, long life, relatively low cost, component durability and resistance to shock and vibration, and very good color performance and power output levels. Still other types of printers have adapted CRT devices as exposure sources. Printers employing lasers have also been developed to provide "flying spot" devices using a laser and a spinning polygon scanner, in similar fashion as in desktop laser printers.

Any type of imaging method for photosensitive media provides exposure radiation to which the media responds in a controlled manner. As is well-known, exposure energy is a factor of both the intensity of light radiation and the amount of time the radiation is applied, expressed in the familiar equation:

$$E=It \tag{1}$$

where I corresponds to the intensity and t corresponds to exposure duration.

Where a complete image frame is exposed in one operation, such as is done in conventional optical exposure and with two-dimensional spatial light modulators such as LCDs, control of the time factor t is relatively straightforward. For electronic images, each pixel in the image can be exposed during the same time interval. However, where only a portion of the image is exposed at a time, such as with the polygon scanner or linear light modulator approach, control of exposure time t becomes more complex. With these printers, a scanning sequence must scan the exposure beam or beams across the media at a constant rate and intensity for each pixel in order to maintain uniformity in the output image.

In the flying-spot imaging apparatus used in laser printers, the spinning polygon and cooperating optical system are designed to control these factors to provide substantially uniform exposure to each pixel in the image. One solution, as disclosed in U.S. Pat. No. 4,835,545 (Mager et al.) adjusts the intensity of the exposing laser based on the sensed velocity of a photosensitive medium as it is being moved past a laser imager scan line. U.S. Pat. No. 4,620,200 (Fukai) discloses another flying spot apparatus which measures the speed of the scanning spot and makes corrections in the intensity of the beam based on the speed. Both of these references, however, are high cost apparatuses.

Linear array printers present a different set of difficulties. With a linear scanner printing system, a precision mechanical arrangement is needed to provide mechanical movement of the printhead relative to the photosensitive medium. As is emphasized in commonly-assigned U.S. Pat. No. 4,475,115 (Garbe et al.), it is considered to be impractical and expensive to implement a scanning mechanism that, by itself, provides the required precision needed for transporting a photosensitive media past a linear array of exposure sources without some amount of error, which results in banding or other motion-related non-uniformities in the output image. Additional compensation is required from timing control circuitry.

Facing this same problem for image sensing applications, input optical scanning apparatus have used a number of techniques for scanning a multipixel linear sensor across a platen. For example, U.S. Pat. No. 6,037,584 (Johnson et al.) discloses a mechanical system with improved motion accuracy, in which an exposure control system varies exposure time for each pixel to compensate for speed variations and varies the gain applied to the sensed signal based on exposure time variations. Similarly, U.S. Pat. No. 6,576,883 (McCoy) discloses exposure control for an optical scanner, using non-linear gain compensation for exposure time variation. Both U.S. Pat. Nos. 6,037,584 and 6,576,883 provide useful techniques for input optical scanning using a linear sensor, however, the challenges faced in printing by exposure from an array of light sources are considerably more formidable, due to higher resolution and positional accuracy requirements and to response sensitivity characteristics of the photosensitive medium itself. Relatively considered, the accuracy requirements of optical printing are an order of magnitude higher than those of ink jet printing.

Laser thermal printing apparatus have employed various techniques for scanning a high-precision imaging printhead across the surface of a photosensitive medium with the timing accuracy necessary for accurate exposure. For example, the Kodak Approval Digital Proofing System uses a configuration in which a multichannel printhead travels in a path parallel to the axis of a rotating vacuum drum, with the substrate held in place on the vacuum drum. This arrangement is suitable for the large-format prepress imaging environment; however the size, complexity, and expense of a rotating vacuum drum prevents the use of this type of solution in a low-cost desktop optical printing system.

U.S. Pat. No. 6,422,682 (Kaneko et al.) discloses a carriage-mounted scanner that can be used interchangeably for ink jet printing or for optical scanning. The apparatus of U.S. Pat. No. 6,422,682 provides positional precision using an encoder strip and accumulation time measurement. This mechanism compensates for inherent inaccuracies in motor and drive mechanics for a carriage-mounted scanning head. Again, however, while corrective measures applied to the apparatus design compensate for tolerance errors in both position and timing, the end-result is suitable only for optical sensing or for ink jet droplet placement. Relatively considered, the accuracy requirements of optical printing are an order of magnitude higher than those of ink jet printing. The challenge of high-resolution optical printing using a carriage-mounted printhead, are not addressed in either U.S. Pat. Nos. 6,037,584; 6,576,883; or U.S. Pat. No. 6,422,682 and not satisfactorily met using solutions that have worked for prepress imaging systems.

It is instructive to observe that conventional ink jet printers have successfully employed carriage-mount designs using an encoder strip, as is employed in U.S. Pat. No. 6,422,682. The use of an encoder strip helps to compensate for velocity variations as the carriage reciprocates back and forth across the print platen. It must be emphasized that position, rather than dwell time, is the key consideration for placement of ink jet droplets onto a substrate. For example, the ink jet printhead can be controlled to eject drops at different rates during ramp-up and ramp-down as the printer carriage moves from one end of the print platen to the other. That is, in a carriage-mounted ink jet printhead, variations in printhead speed over the carriage length are compensated for by sensing markings on the encoder strip. Again, however, while conventional use of an encoder strip provides sufficient accuracy for ink droplet placement at the needed resolution, optical imaging requires significantly finer resolution. Moreover, by comparison, ink jet printing using a linear printhead of nozzles is inherently more "forgiving" in other ways than is optical printing using a linear array of light sources. For example, an ink jet printhead can be passed over the same area of the print substrate multiple times, allowing various techniques for interleaving, feathering, and patterning compensation to be readily applied. Optical printheads do not enjoy this advantage. Moreover, the number of individual channels in a linear optical printhead must be kept low due to power dissipation in the printhead.

Thus, it can be seen that requirements for high-resolution accuracy and for compensation of velocity changes along the scanning head path constrain the design of optical printheads using linear exposure arrays. As with the device disclosed in U.S. Pat. No. 4,475,115, conventional design approaches strongly favor stationary mounting for a printhead using a linear array of exposure sources and scanning of the photosensitive medium relative to this stationary exposure array, rather than using a carriage-mounted printhead. This conventional approach, however, does not allow optical printhead design to benefit from some of the advantages of carriage mounting designs, including compact size (particularly when using LED arrays), reduced cost for lower manufacturing volumes, and improved throughput.

SUMMARY OF THE INVENTION

It is an object of the present invention to provide a printer having a linear array of exposure sources in a carriage-mounted arrangement. With this object in mind, the present invention provides a printing apparatus for exposing an image onto a photosensitive medium, comprising:

(a) a printhead comprising a linear array of exposure sources, each exposure source operable at a variable intensity;

(b) a shuttle mechanism for moving the printhead over the photosensitive medium in a reciprocating motion between one end of a carriage assembly and a second end of the carriage assembly;

(c) an encoder coupled to the shuttle mechanism for providing an index signal at each of a plurality of increments of position of the shuttle mechanism along the carriage assembly; and (d) exposure control logic for calculating a shuttle velocity according to index signal timing and for adjusting the variable intensity of each exposure source according to the shuttle velocity.

It is a feature of the present invention that it compensates for velocity variations in printhead movement to achieve uniform exposure over the width of the photosensitive medium.

It is an advantage of the present invention that it provides a scanned optical printhead having a high duty cycle, able to provide exposure energy during acceleration and deceleration, thus increasing printer throughput.

It is an advantage of the present invention that it provides an imaging solution for photosensitive media that can be scaled to suit a range of media widths, in contrast to laser scanning apparatus or drum-based imaging apparatus.

It is an advantage of the present invention that it allows the design of a compact printing apparatus for high-resolution optical imaging.

It is a further advantage of the present invention that it allows the use of a low-cost LED array as a linear exposure source.

It is a further advantage of the present invention that it enables low cost components to be used for carriage movement across the surface of the photosensitive medium.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Hardware Components

Figure 1:
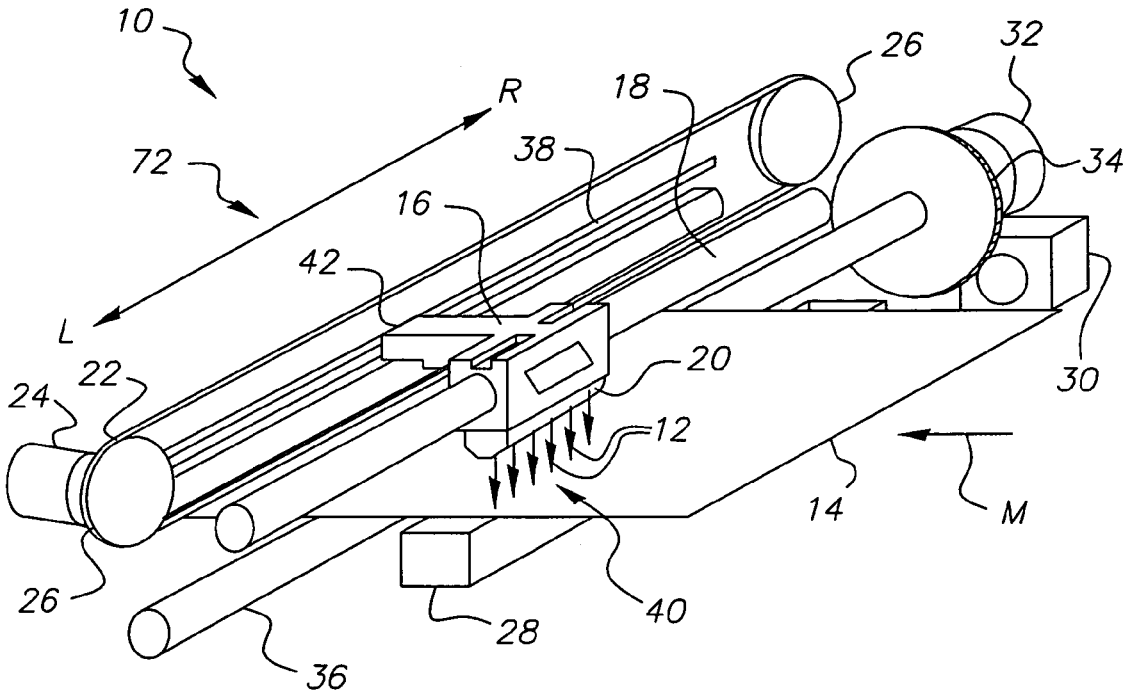
FIG. 1 is a perspective view of printing apparatus components according to the present invention.

Referring to FIG. 1, there is shown a perspective view of essential hardware components of a printing apparatus 10 of one embodiment of the present invention. A printhead 20 having a plurality of exposure sources 12 arranged as a linear array of exposure sources 40 is reciprocated within a carriage assembly 72 between a left position L and a right position R in order to expose pixels onto a photosensitive medium 14 in a series of swaths. Printhead 20 is mounted in a carriage-mount arrangement, in which a shuttle 16 is propelled along a rail support 18 by a belt drive 22. A drive motor 24 and pulleys 26 are arranged to move shuttle 16 back and forth in reciprocating fashion, in a manner that is similar to that used for ink jet printheads. A sheet of photosensitive medium 14, held in position along a platen 28, such as a vacuum platen, is moved in a direction M that is orthogonal to the direction of shuttle 16 motion, indexing the sheet forward as each swath is exposed. A stepper drive motor 30, equipped with an encoder 32, drives an anti-backlash gear 34 and traction grit roller 36 or other suitable mechanism for indexing the sheet of photosensitive medium 14 in the M direction. An encoder strip 38 is sensed by a sensor 42 in order to determine the velocity of shuttle 16 during each part of its travel from position L to R and back. As the printhead is in motion printing to the photosensitive medium, the photosensitive medium is motionless. When the printhead is stopped at one edge of the photosensitive medium between cycles, the photosensitive medium is advanced a predetermined distance and once again stopped prior to the next printing evolution. This motion of the photosensitive medium is often called stepwise fashion.

In a preferred embodiment, exposure source 12 is an LED, so that printhead 20 uses an LED array as its linear array of exposure sources 40. LED array could be an LED die array, as is described in commonly-assigned copending application Ser. No. 10/700,832, cited above. The line of exposure sources 12 in linear array of exposure sources 40 is typically disposed at some non-zero angle relative to the travel direction of shuttle 16 between positions L and R, so that a swath consisting of multiple raster lines can be exposed in a single traversal over the width of photosensitive medium 14 between positions L and R. The relative angle of orientation can be adjusted to provide a suitable resolution, using techniques well known in the art of imaging using a linear printhead.

Encoder strip 38 must have a resolution at least as high as the pixel resolution of the printer to enable precise pixel placement in spite of the velocity variations of the printhead. This typically will be a higher resolution than similar types of encoders used with ink jet printing apparatus, for example. Where a conventional ink jet printer can use an encoder strip having index markings every 0.2 mm, the method of the present invention typically requires that encoder strip 38 have at least twice this accuracy. Encoder strip 38 can be fabricated using a number of possible materials. In a preferred embodiment, encoder strip 38 is a mylar strip.

Adjustments to the Signal Path for Imaging

Figure 2:
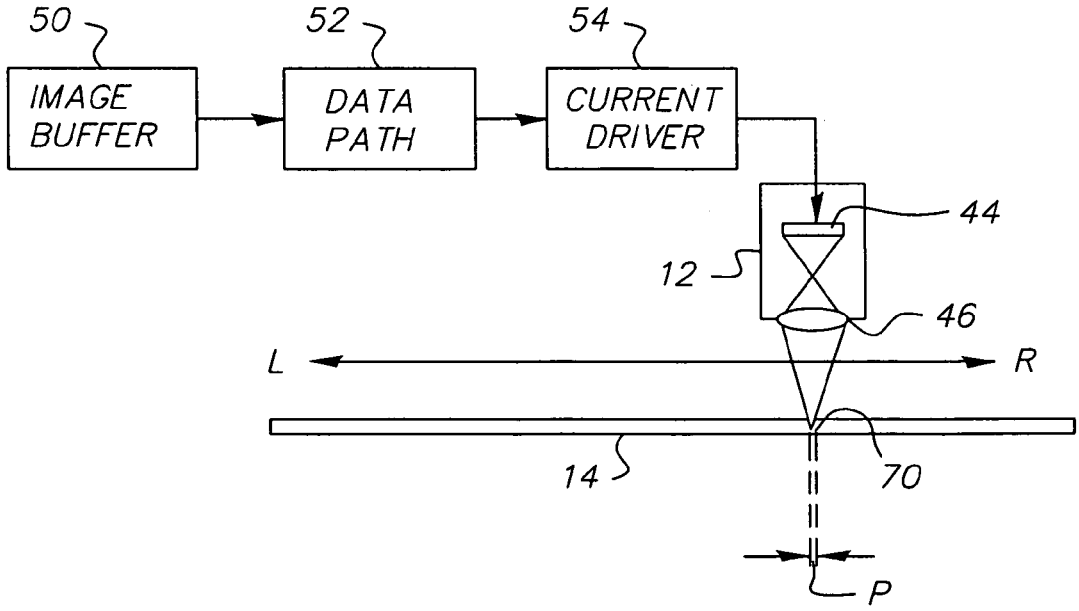
FIG. 2 is a block diagram showing the signal path for driving a single LED in an exposure array according to the present invention.

Referring to FIG. 2, there is shown a block diagram of the signal path for each individual exposure source 12. In the embodiment of FIG. 2, exposure source 12 uses an LED 44 having an associated lens element 46. Image data from an image buffer 50 is directed along a data path 52 to a current driver 54. Current driver 54 provides a variable output current to exposure source 12. For LED 44, the level of current provided determines the exposure intensity provided to photosensitive medium 14 to form a pixel 70. As is shown in FIG. 2, exposure source 12 is moved as part of linear array of exposure sources 40 (as shown in FIG. 1) along the line between position L and position R.

Figure 3A:
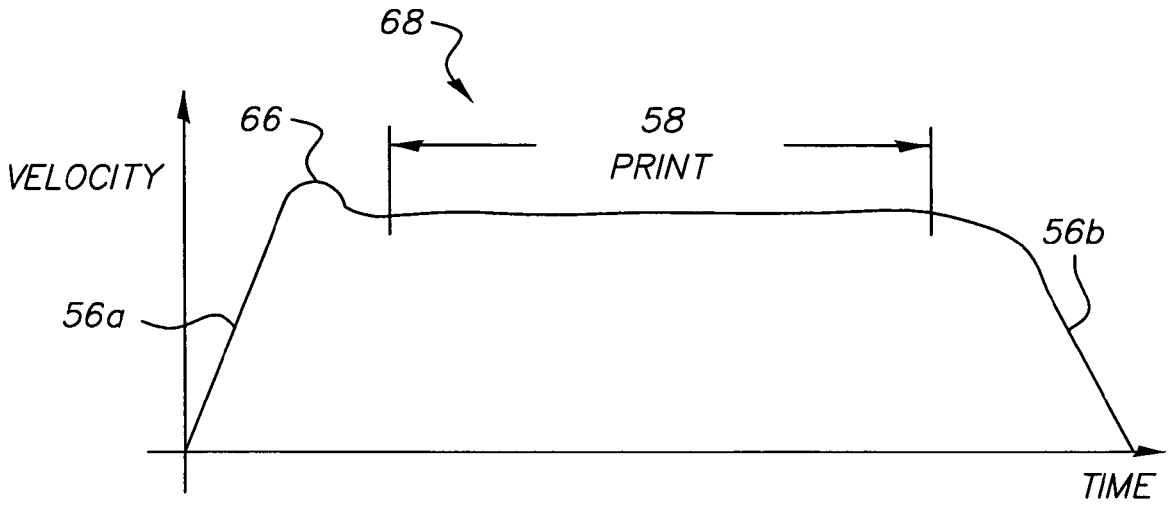
FIG. 3A (PRIOR ART)
FIGS. 3*a* and 3*b* are graphs showing the print interval relative to changing velocity of the printhead using the method and apparatus of the present invention.

Referring to FIG. 3*a*, there is shown a velocity-time curve 68 for one traversal of shuttle 16 from L to R position (or, alternately, from R to L position) as was shown in FIG. 1, and the expected print interval 58 for exposure using linear array of exposure sources 40 based on prior art approaches. In prior art optical imaging systems, conventional practice has been to provide exposure energy only when shuttle 16 velocity is relatively stable, following a ramp-up period 56*a* and after any overshoot 66 and preceding any ramp-down period 56*b*.

Figure 3B:
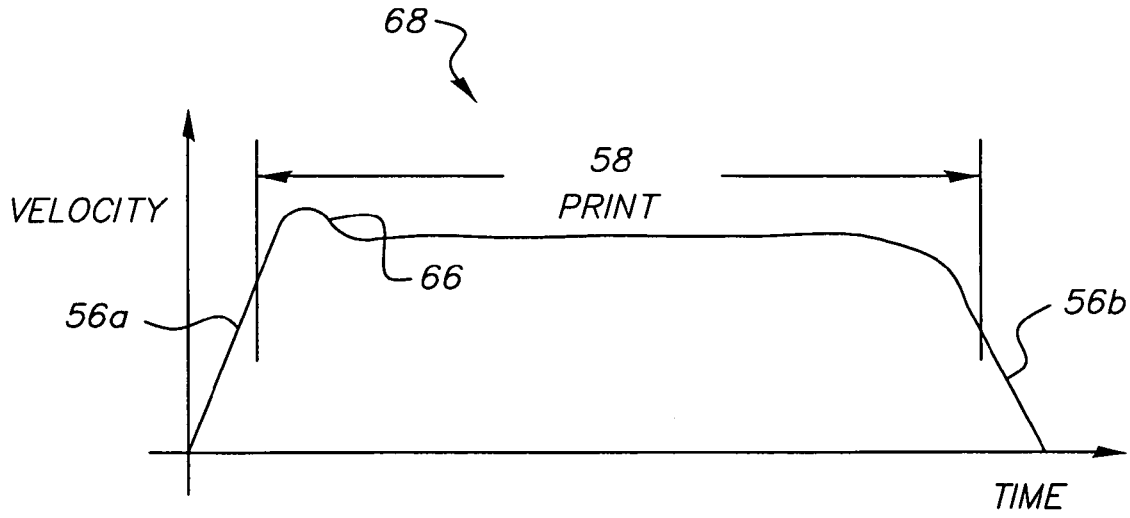

Referring to FIG. 3*b*, in contrast to FIG. 3*a*, the characteristic shape of velocity-time curve 68 is the same; however print interval 58 can be extended over portions of ramp-up period 56*a*, even during overshoot 66, and during ramp-down period 56*b*, using the apparatus and method of the present invention.

Figure 4:
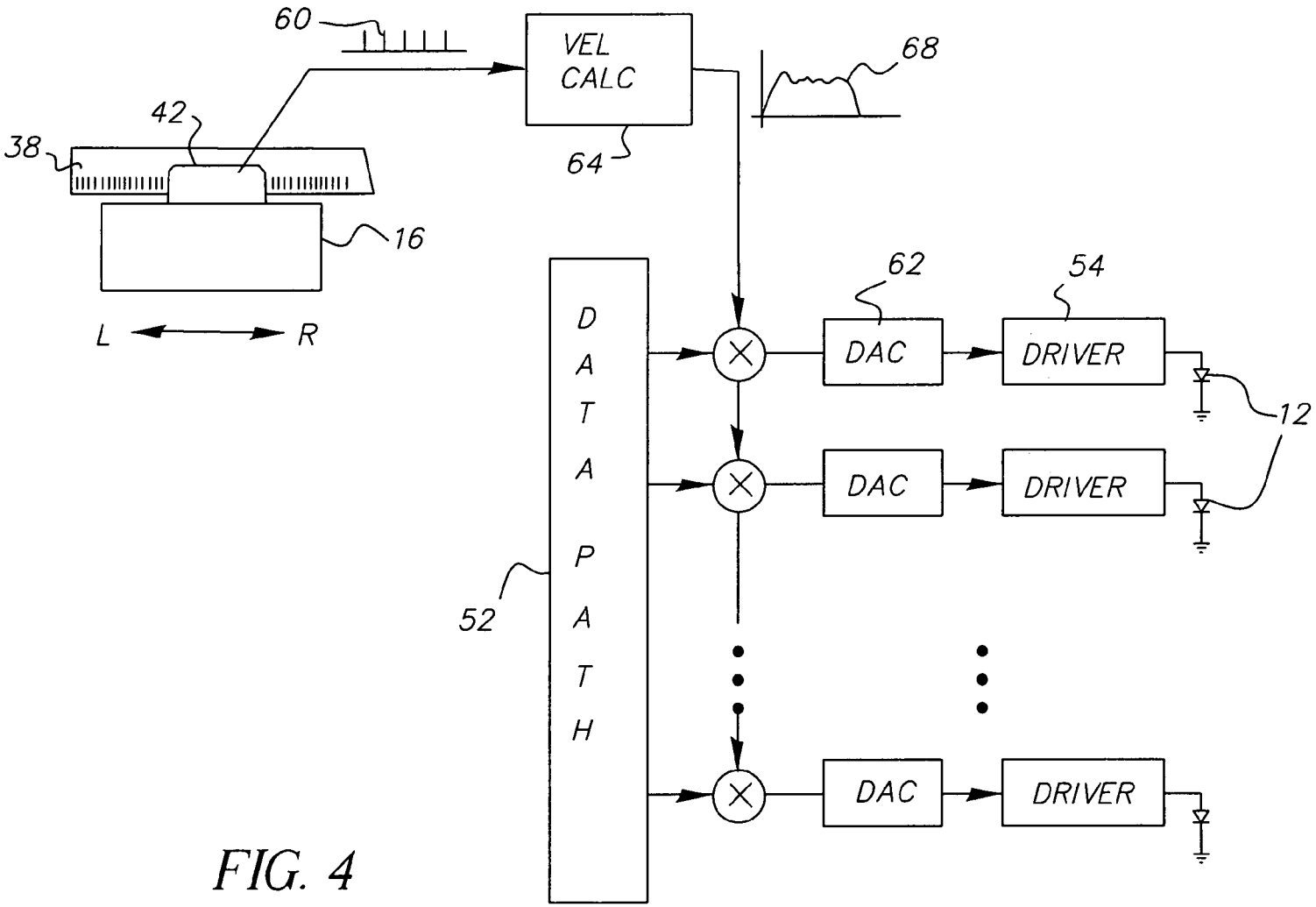
FIG. 4 is a block diagram showing the feedback loop for the data path of individual exposure sources according to the present invention.

Referring to the block diagram of FIG. 4, that portion of the signal path of FIG. 2 that uses velocity information is shown. Encoder pulses 60 from encoder strip 38, as detected by sensor 42, are used as input to an arithmetic logic processor 64 for determining the velocity of shuttle 16, as represented by velocity-time curve 68. Based on this velocity calculation, a correction factor is combined with image data in data path 52 to condition the digital data input to a digital-to-analog converter (DAC) 62 that cooperates with current driver 54 to control the output intensity of each exposure source 12.

Determining the Velocity of Printhead 20

Figure 5:
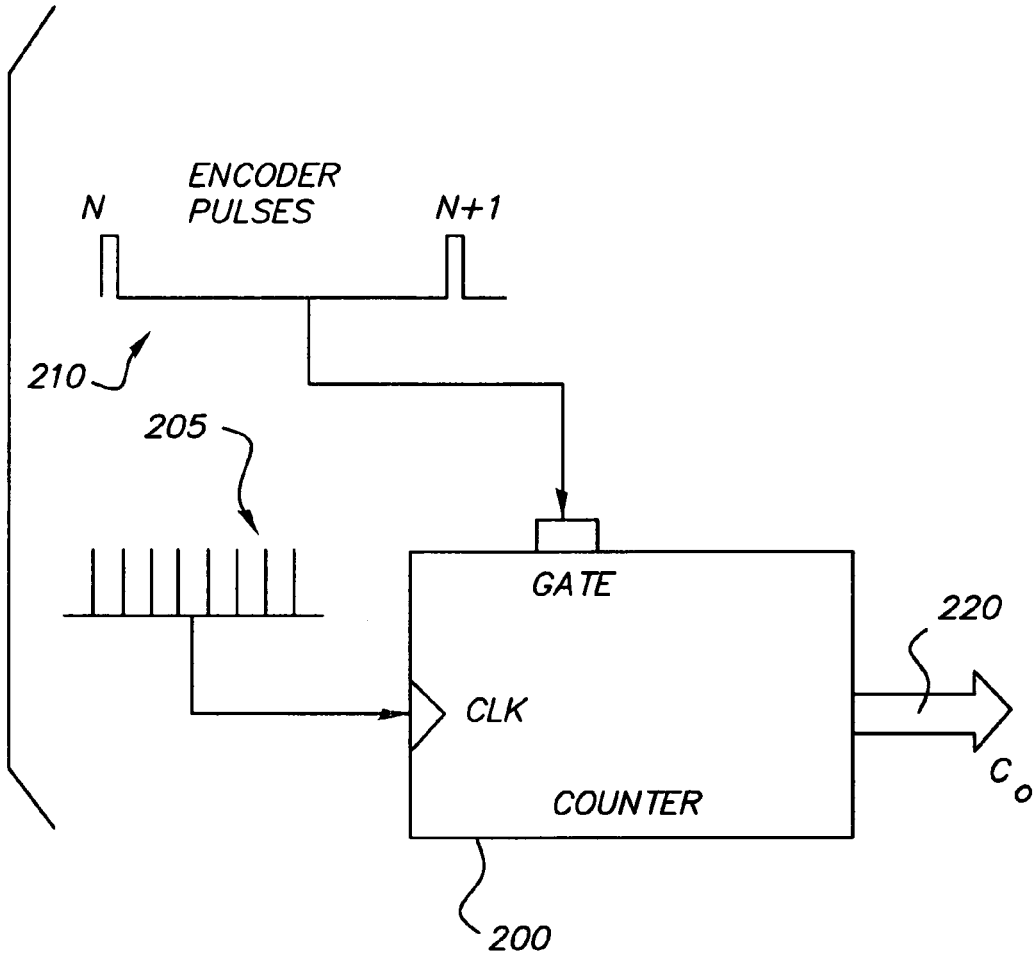
FIG. 5 is a schematic block diagram showing the overall function of measurement circuitry for determining velocity in one embodiment.

Referring again to FIG. 4, arithmetic logic processor 64 computes printhead 20 velocity information from encoder pulses 60 using a method where the elapsed time between one encoder pulse 60 and the next is measured against a clock, using a counter circuit. The schematic block diagram of FIG. 5 shows how arithmetic logic processor 64 of FIG. 4 performs this computation in a preferred embodiment. As shown in FIG. 5, any two successive encoder pulses 210 are separated by a variable time interval. Pulse N precedes pulse N+1 in time with a period that is inversely proportional to the velocity of sensor 42, serving as the encoder strip 38 read head, coupled to printhead 20. The encoder pulse period is measured by a counter 200 which counts the number of high speed clock pulses 205 that occur between encoder; pulse N and N+1. In order to determine the encoder pulse time period accurately and with sufficient resolution, high speed clock pulses 205 must have a substantially higher frequency than encoder pulses 210. Typically, high speed clock pulses 205 are at least 1000 times faster than encoder pulses 210. High speed clock pulses 205 are supplied by a separate clock circuit (not shown) which typically uses a quartz oscillator, using clock generation techniques that are well known to those skilled in the electronics arts.

$$T_{enc} = \frac{1}{E_R \times V_{PH}} \tag{2}$$

where $T_{enc}$ is the period of encoder pulses 210, $E_R$ is encoder pulse resolution and $V_{PH}$ is the velocity of printhead 20. The value of counter 200 output $C_o$ 220 directly corresponds to the time between one encoder pulse 210 (pulse N) and the next (pulse N+1). The value of $T_{enc}$ can be measured from this $C_o$ value using the following equation:

$$T_{enc} = \frac{C_o}{F_{clk}} \tag{3}$$

where $F_{clk}$ is the frequency of clock pulses 205.

Using Equations 2 and 3, the velocity of printhead 20, $V_{PH}$, is therefore:

$$V_{PH} = \frac{F_{clk}}{C_o \times E_R} \tag{4}$$

For simplicity in subsequent description, the subscript $_{PH}$ is dropped, allowing V to represent printhead 20 velocity. Once velocity V of printhead 20 is determined, either of two basic approaches can be used for error correction: using either full scale factor modulation or fractional error modulation.

Correction for Exposure Error Using Full Scale Factor Modulation Method

Full scale factor modulation allows exposure error correction using the full velocity value V of printhead 20, obtained as described hereinabove.

Referring back to FIG. 2, in order to form pixel 70, the exposing beam spot from exposure source 12 moves across the surface of photosensitive medium 14 with a velocity V. Thus, the beam spot exposes the region of pixel 70 for a time that is dependent on this velocity V and the width P of pixel 70. Using this analysis, exposure time is then proportional to the quotient:

$$\frac{P}{V} \tag{5}$$

Exposure E can thus be expressed using:

$$E = I \times \frac{P}{V} \tag{6}$$

It can be seen that uniform exposure occurs if I, P, and V are all constant. However, as is shown in the graphs of FIGS. 3*a* and 3*b*, V varies with time and would be appropriately expressed as follows:

$$V(t)=V_{dc}(1+\epsilon(t)) \tag{7}$$

Where $V_{dc}$ is the constant nominal printing velocity and $\epsilon(t)$ is the velocity variation due to perturbations in drive motor 24 (FIG. 1). With changing velocity, exposure is no longer constant, but would be better expressed as follows:

$$E = I \times \frac{P}{V_{dc}(1+\varepsilon(T))} \tag{8}$$

By modulating the drive current to exposure sources 12 with respect to time, as shown in FIG. 4, a constant exposure can be maintained. This can be expressed by incorporating a modulation term M(t) in the basic equation, as follows:

$$E = I \times M(t) \times \frac{P}{V_{dc}(1+\varepsilon(t))} \tag{9}$$

Working with this equation to obtain constant exposure yields the modulation term as:

$$M(t)=V_{dc}(1+\epsilon(t)) \tag{10}$$

Using this method, the modulation term for drive current is set equal to the measured velocity of shuttle 16, as indicated by encoder pulses 60 from shuttle 16 movement. Then, for a particular size P of pixel 70:

$$E=I\times P\times K \tag{11}$$

Where K is a constant gain factor added to achieve the desired exposure value.

Using these relationships and knowledge of the specific exposure response characteristics of an individual photosensitive medium 14, a skilled worker would be capable of implementing the control sequence shown in FIGS. 2, 4, and 5 for providing suitable drive signals to exposure sources 12 in a multichannel printhead. Depending on the response speed of the compensating system, the arrangement of FIG. 4, using the compensation control logic outlined above, could be used to allow imaging not only during ramp-up or ramp-down (56*a* or 56*b*), but also during overshoot 66 or other transient changes in shuttle 16 velocity.

Correction for Exposure Error Using Alternate Fractional Error Modulation Method For a printer system of this type, it is known that velocity variations in the range of 0.1% or greater produce visible artifacts in images. Therefore, using the previously described full scale factor modulation method to correct for non-uniform velocity disturbances requires that the velocity modulation term have an accuracy better than 0.1%. However, in practice, a digital representation of the velocity correction factor obtained using the full scale factor modulation method would require a resolution greater than 10 bits. As shown in FIG. 4, the image data in each channel of printhead 20 must be multiplied by the velocity correction factor when using the first error modulation method, described above. Typically, this type of multiplication would be implemented digitally in a field-programmable gate array (FPGA) device. However, as the number of printhead channels increases, the number of gates used in the FPGA increases in turn, requiring a correspondingly larger and therefore more expensive device. Another expense factor is the cost of digital-to analog converters 62 that convert the digital image data to a corresponding analog variable that controls the current drive circuit.

Figure 6B:
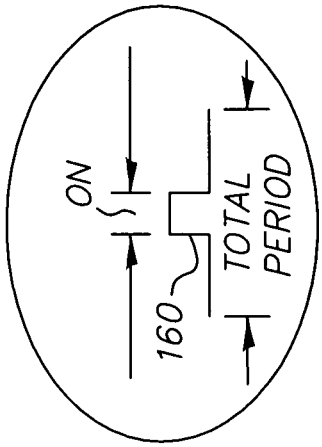
FIG. 6*a* and 6*b* are schematic block diagrams showing the signal path for adjusting light intensity due to velocity change.

For cost-sensitive applications using a large number of imaging channels in printhead 20, pulse width modulation (PWM) techniques are employed to modulate drive current according to the image data. PWM technique drives a fixed current through a channel, but varies the pulse width ratio, or ON time of the current signal. Referring now to an output PWM waveform 160, shown in FIG. 6*b*, the ratio of ON time to TOTAL PERIOD time is proportional to a desired effective current level. As an example in FIG. 6*b*, PWM waveform 160 shows a PWM pulse that drives about 20% of the fixed current through a channel. Here, the ratio of ON time to TOTAL PERIOD time for PWM waveform 160 is set to 20%.

Advantageously, the drive circuit for a PWM current drive can be fairly inexpensive, typically requiring a current source, a voltage buffer, and a MOSFET transistor for each channel. The resulting output of the PWM function, then, is the product of the fixed current times the PWM duty cycle. For printing apparatus 10 of FIG. 1, the effective level of LED drive current for each exposure source 12 can be controlled in this way, based on both the PWM duty cycle and the level of the fixed current. Alternatively, the fixed current level can be continuously adjusted as a modulation factor for the pulse width modulated image data.

Referring to the previously described modulation method, it has been noted that velocity correction modulation term M(t) in equation (10) requires a full scale representation of the velocity of printhead 20. The alternate modulation approach of this embodiment corrects velocity V exposure errors, but requires lower digital resolution than the full scale factor modulation method described above and still maintains the needed 0.1% accuracy. This alternate approach measures the disturbance value $\epsilon(t)$ and utilizes this measured value to correct exposure for dynamic changes in velocity V. The nominal velocity $V_{dc}$ of printhead 20 is constant and is known from the system requirements for printing apparatus 10. Generally, working maximum and minimum values of velocity disturbance are also known and specified. Therefore, it is possible to dynamically measure and use only the deviation from this nominal velocity in correction. One advantage of this method relates to the relatively narrow range of velocity deviation. Certainly, the range of the of the velocity deviation from nominal, represented as $\epsilon(t)$, is always much less than the total velocity. For example, achieving a velocity control of +/−5% is relatively easy to accomplish with reasonably low cost components. If this scale of error is represented as an 8-bit number, the resolution is 10%/256 or about 0.039% which is well below the 0.1% accuracy resolution requirement.

Referring again to Equation 10, it can be seen that modulation factor M(t), incorporates the measured nominal velocity $V_{dc}$. Instead of dynamically measuring this $V_{dc}$ value, a constant value $C_v$, can be introduced in its place, made to correspond to the nominal printhead velocity $V_{dc}$. Substituting into Equation 9 gives:

$$E = I \times C_v \times (1 + e_m(t)) \times \frac{P}{V_{dc}(1 + \varepsilon(t))} \tag{12}$$

where $C_v = V_{dc}$ and $e_m(t)$ is the measured velocity deviation$=\epsilon(t)$.

The intensity I of LED 44 is proportional to the LED drive current $i_{LED}$ times a constant $K_d$ which is associated with a particular LED device. The intensity is therefore expressed as:

$$I = K_d \times i_{LED} \tag{13}$$

Figure 6A:
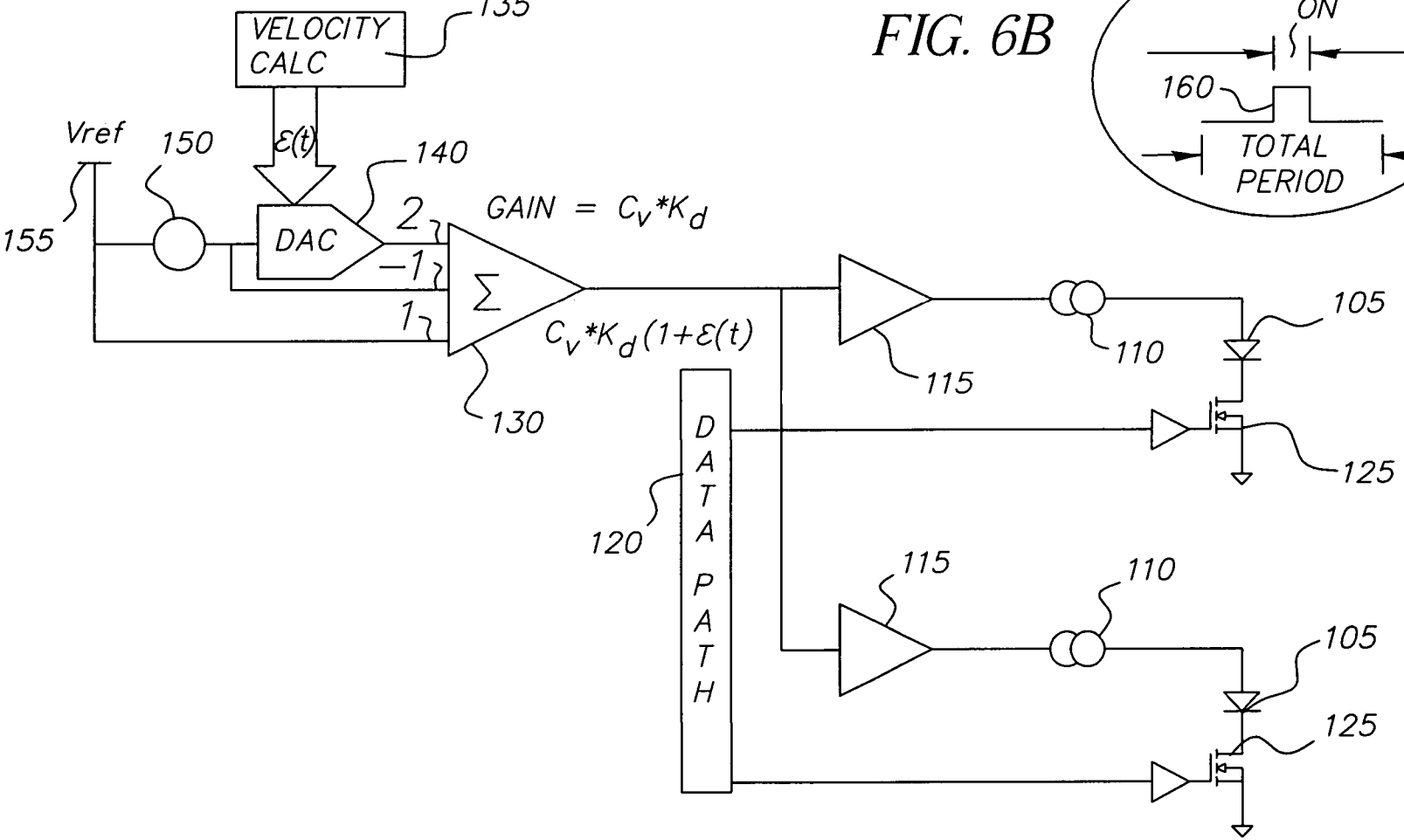

Referring now to FIG. 6*a*, velocity calculation circuit 135 need only determine and represent the velocity error, that is, the $\epsilon(t)$ component as, for example, an 8-bit number. Any exposure error due to velocity perturbations $\epsilon_m(t)$ can then be corrected by modulating the LED current $i_{LED}$ with the constant factor Cv and the time varying factor $(1+\epsilon_m(t))$.

FIG. 6*a* depicts how an 8-bit representation can be used to correct for velocity exposure errors. The LED current driver consists of PWM MOSFET switch 125 which is controlled by PWM signals proportional to image data values from data path circuitry 120. A voltage buffer 115 sets the level for a voltage controlled current source 110 which supplies the drive current to an LED 105. The magnitude of LED drive current is proportional to the input level and the transconductance gain $K_i$ of current source 110. The input to voltage buffer 115 is supplied by the output of a summing amplifier 130 whose gain is set to $C_v * K_d$. The value of $C_v$ is a suitably scaled value representative of the nominal printhead velocity. The factor $K_d$ is introduced to allow further scaling of the drive current. This factor is added to account for the individual characteristics of the LED power output versus current. Usually, $K_d$ is adjusted individually for each channel to bring all LED exposure sources 12 to the same power level for the same code value output, as a PWM waveform from the data path.

Summing amplifier 130 has three input signals: the input from a multiplying digital-to-analog converter (DAC) 140 at a gain of +2, the input from a voltage divider 150 at a gain of −1, and the input of Vref 155 at a gain of 1. Multiplying DAC 140 is a type of D to A converter that outputs a signal proportional to the digital value times a reference input voltage applied to the IN terminal. Voltage divider 150 would typically consist of a potentiometer or fixed resistors. $V_{ref}$ is a stable voltage source whose magnitude is scaled to suitable value for the system.

The value output by a velocity calculation block 135 is a digital value representing the measured velocity variation of the printhead from the nominal value. For an 8-bit digital representation this has a value between 0 and 255, where 0 to 127 represents the negative variation and values 128 to 255 are the positive variations. This number can be scaled so that the total velocity disturbance can be encoded into the full 8-bits. As an the example, if the variation was +/−5%, the divider 150 would be set to 0.05 and the resulting output of the summing amplifier would be as follows:

$$V_o = O_v \times (1 + 0.05 \times (2 \times N/256 - 1)) \times V_{ref} \times K_d \tag{14}$$

where N is a binary with values from 0 to 255.

Upon inspection it can be seen that as N varies from 0 to 255, the factor (1+0.05×(2N/256−1)) will vary from 0.95 to 1.05 which corresponds to the normalized maximum and minimum value of the instantaneous velocity of printhead 20.

From Equation 12 the intensity of LED exposure source 12 is given as, $I = K_d \times i_{LED}$ and it was shown that $i_{LED} = V_o \times K_i$. From this it can be seen that:

$$I = V_o \times K_d \times K_i \tag{15}$$

Substituting Equation 14 into Equation 15, and noting that the factor $K_d$ is already accounted for in Equation 14, gives a final expression for I as:

$$I = C_v \times (1 + 0.05 \times (2N/256 - 1)) \times V_{ref} \times K_d \times K_i \tag{16}$$

When this expression for I is substituted into Equation 9 the exposure becomes:

$$E = C_v \times (1 + .05 \times (2 \times N/256 - 1)) \times \frac{K_r}{V_{dc}(1 + \varepsilon(t))} \quad (17)$$

where $K_T = V_{ref} \times K_d \times K_i$ and where the factor $C_v \times (1+0.05 \times (2N/256-1))$ equals and cancels the printhead velocity term $V_{dc}(1+\epsilon(t))$ yielding constant exposure even with velocity error of:

$$E = K_T \quad (18)$$

Finally, when the image data from the data path generates a modulated PWM waveform 160, this, in turn, modulates the current drive to the LED and gives:

$$E = ID \times K_T \quad (19)$$

where ID is the image data PWM modulation, which varies directly with code values from 0 to 100% representing the image data. In this way, exposure E is now shown to be controlled by the image data modulation only. Exposure variations from velocity errors have been completely cancelled.

Alternative Embodiments and Options

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, exposure sources 12 could be embodied as LEDs or as other types of light sources. The function of encoder strip 38 could be provided by an alternate type of positional encoder. A number of different possible arrangements could be used for reciprocation of shuttle 16 across the width of photosensitive medium 14. The mechanism of shuttle 16 could use any suitable arrangement of drive, support, and guide structures, as would be familiar to those versed in the mechanical arts. A variety of types of drive motors could be used for moving printhead 20 across the surface of platen 28, including a linear motor or linear traction drive, for example.

While FIG. 1 shows essential hardware components specific to one embodiment of the present invention, alternative arrangements are possible. Power supply, external packaging, data interface ports, and other standard physical features are not shown in FIG. 1 but would be provided, as with standard types of printing apparatus. Of course, protection from stray light may also be provided for components within printing apparatus 10, such as to prevent inadvertent exposure or degradation of photosensitive medium 14 if necessary. Photosensitive medium 14 itself may require conventional wet chemical processing or may require heat energy or some other type of additional processing in order to provide the final printed image.

Calibration of carriage assembly 72 components could follow a conventional sequence for printhead calibration, such as would be used, for example, for an ink jet printhead. In this conventional sequence, steps for calibration would include generation of a calibration print, measurement of error and derivation and application of adjustment values, possibly including repeated cycles for improved results. Calibration would typically be required at the time of manufacture and setup and, possibly, periodically during operation of the printing apparatus.

It can be appreciated that the apparatus of the present invention provides a carriage-mounted printhead using a linear array of exposure sources, which is a configuration that has not yet been successfully commercialized for low-cost printing apparatus of any size. Using the techniques of the present invention, a relatively inexpensive printing apparatus of this type can be manufactured and used to provide high-quality images on photosensitive media, with high throughput speeds.

In a preferred embodiment, the apparatus of the present invention is used for exposure of monochrome images, providing a high-resolution desktop printer for diagnostic images. However, it can be readily appreciated that an apparatus according to the present invention could also be used for exposure of a broader range of image types, including circuit traces, for example. The apparatus of the present invention could be scaled to print images on large sheets of photosensitive media. The photosensitive medium used could be silver-halide-based or could use some other mechanism for forming an image. A laser ablation imaging system could be provided using a suitable arrangement of exposure sources and media.

More than one linear array could be provided as part of printhead 20, allowing color imaging using separate banks of exposure sources 12, each having a different wavelength, for example.

Thus, what is provided is an apparatus and method for a scanning optical printhead using a carriage-mounted linear exposure array with exposure control.

PARTS LIST

10 printing apparatus
12 exposure source
14 photosensitive medium
16 shuttle
18 rail support
20 printhead
22 belt drive
24 drive motor
26 pulleys
28 platen
30 stepper drive motor
32 encoder
34 anti-backlash gear
36 traction grit roller
38 encoder strip
40 linear array of exposure sources
42 sensor
44 LED
46 lens element
50 image buffer
52 data path
54 current driver
**56*a*** ramp-up period
**56*b*** ramp-down period
58 print interval
60 encoder pulses
62 digital-to-analog converter
64 arithmetic logic processor
66 overshoot
68 velocity-time curve
70 pixel
72 carriage assembly
105 LED
110 current source
115 voltage buffer

120 data path circuitry
125 switch
130 summing amplifier
135 velocity calculation circuit
140 digital-to-analog converter (DAC)
150 voltage divider
155 Vref
160 PWM waveform
200 counter
205 clock pulse
210 encoder pulse
220 counter output The inventioned claimed is:

1. A printing apparatus for exposing an image onto a photosensitive medium, comprising:

(a) a printhead comprising a linear array of exposure sources, each said exposure source operable at a variable intensity;

(b) a shuttle for moving the printhead over the photosensitive medium in a reciprocating motion between one end of a carriage assembly and the other;

(c) an encoder coupled to the shuttle mechanism for providing an index signal at each of a plurality of incremental positions of the shuttle mechanism along the carriage assembly; and (d) exposure control logic for calculating an instantaneous shuttle velocity according to index signal timing and for adjusting the variable intensity of each said exposure source according to said shuttle velocity.

2. The printing apparatus as in claim 1 wherein said array of exposure sources comprises an LED array.

3. The printing apparatus as in claim 1 wherein said shuttle mechanism comprises a belt pulley.

4. The printing apparatus as in claim 1 wherein said encoder is an encoder strip.

5. The printing apparatus as in claim 1 wherein said photosensitive medium moves in a stepwise fashion between printing cycles.

6. The printing apparatus as in claim 1 wherein said photosensitive medium is motionless during each printing cycle.

7. The printing apparatus as in claim 1 wherein the same adjustment is made to the intensity of each of said exposure sources.

8. The printing apparatus as in claim 1 wherein said linear array of exposure sources is comprised of red, green, and blue light sources.

9. A method of printing by exposing an image onto a photosensitive medium, comprising:

(a) providing a printhead comprising a linear array of exposure sources, wherein each exposure source operates at a variable intensity, and wherein said printhead is coupled to a shuttle mechanism;

(b) moving said shuttle mechanism and said printhead over said photosensitive medium in a reciprocating motion between a first end of a carriage assembly and a second end of said carriage assembly;

(c) providing an index signal at each of a plurality of increments of position of the shuttle mechanism along the carnage assembly;

(d) calculating a shuttle velocity timing said index signal; and (e) adjusting said variable intensity of each said exposure source according to said instantaneous shuttle velocity.

10. A method for modulating exposure energy from exposure sources moved in a scan direction across a width of a photosensitive substrate comprising the steps of:

(a) measuring a changing instantaneous velocity of said exposure sources by obtaining a series of encoder signals, wherein each signal corresponds to a position along said scan direction;

(b) deriving a full scale correction factor for said changing velocity;

(c) multiplying said full scale correction factor to said predetermined target exposure intensity; and (d) correcting said exposure errors due to said changing instantaneous velocity, resulting in uniform exposure density across a width of said photosensitive substrate.

11. A method for modulating exposure energy from exposure sources moved in a scan direction across a width of a photosensitive substrate comprising the steps of:

(a) measuring a changing instantaneous velocity of said exposure sources by obtaining a series of encoder signals, wherein each signal corresponds to a position along said scan direction;

(b) deriving a fractional correction factor, offset from a constant nominal value for said changing instantaneous velocity;

(c) calculating a correction factor by adding said derived fractional correction factor to a constant value representative of said nominal value for said changing instantaneous velocity;

(d) multiplying said calculated correction factor to said predetermined target exposure intensity; and (e) correcting said exposure errors due to said changing instantaneous velocity, resulting in uniform exposure density across a width of said photosensitive substrate.

12. A printing apparatus for exposing an image onto a photosensitive medium, comprising:

(a) a printhead comprising a linear array of exposure sources, each said exposure source operable at a variable intensity;

(b) a shuttle for moving the printhead over the photosensitive medium in a reciprocating motion between one end of a carriage assembly and the other;

(c) an encoder coupled to the shuttle mechanism for providing an index signal at each of a plurality of incremental positions of the shuttle mechanism along the carriage assembly;

(d) exposure control logic for calculating an instantaneous shuttle velocity according to index signal timing and for adjusting the variable intensity of each said exposure source according to said shuttle velocity; and (e) wherein said photosensitive medium in a stepwise fashion between printing cycles.

* * * * *